US005288267A

United States Patent [19]

Mitchell

[11] Patent Number: 5,288,267

[45] Date of Patent: Feb. 22, 1994

[54] RETROFIT AIR CIRCULATION SYSTEM

[75] Inventor: George Mitchell, Rosemont, Pa.

[73] Assignee: Centercore, Inc., Wayne, Pa.

[21] Appl. No.: 16,071

[22] Filed: Feb. 10, 1993

[51] Int. Cl.[5] ..... F24F 7/007

[52] U.S. Cl. ..... 454/230

[58] Field of Search ..... 454/230, 233

[56] References Cited

U.S. PATENT DOCUMENTS

| | | | |
|---|---|---|---|
| 2,808,237 | 10/1957 | Fosnes | 454/230 X |
| 3,802,168 | 4/1974 | Deckas | 454/230 X |
| 3,850,598 | 11/1974 | Boehm | 454/230 X |
| 4,370,155 | 1/1983 | Armbruster | 454/230 X |
| 4,711,161 | 12/1987 | Swin, Sr. et al. | 454/230 |
| 5,180,332 | 1/1993 | Mitchell et al. | 454/230 |

FOREIGN PATENT DOCUMENTS

| | | | |
|---|---|---|---|
| 2833774 | 2/1980 | Fed. Rep. of Germany | 454/230 |
| 547470 | 11/1925 | France | 454/233 |
| 599050 | 12/1925 | France | 454/230 |
| 249557 | 7/1926 | Italy | 454/230 |

*Primary Examiner*—Harold Joyce

*Attorney, Agent, or Firm*—Eugene E. Renz, Jr.

[57] ABSTRACT

A work station unit for use in an array including at least one work space defined in part by intersecting side walls. The unit comprises an air circulation unit mounted on at least one side wall of the work space, at a location proximate the intersection. An air inlet on the unit draws ambient air into the unit and an air discharge discharges air in a predetermined controlled direction to cooperatively form an envelope of air surrounding a space defined in part by the side walls and in part by air flow out of the discharge and into the air inlet. An individual in the work station is enclosed in air having superior quality to ambient air.

10 Claims, 3 Drawing Sheets

RETROFIT AIR CIRCULATION SYSTEM

FIELD OF THE INVENTION

This invention relates to an improved air circulation system for work space units, and more particularly to a work space unit which may be added to existing work stations without significant modification to the stations.

BACKGROUND OF THE INVENTION

U.S. Pat. No. 4,625,633 in the name of Martin, is a commonly owned Patent which describes a ventilated core unit for service connections useful in work station arrays. Various prior art patents are disclosed in the Martin Patent. The disclosure of all of those patents may be summarized by a statement in the Martin Patent that none of the prior art discloses the benefits of an independently controlled zone unit that is not attached to building HVAC equipment by air ducts.

Martin correctly identifies a modern trend in office furniture and layout arrangements in which small semi-private working cubical are created about a central core with multiple work stations and equipment emitting from that core. The Martin design has been very successful in providing a central core unit which accomplishes both ventilating and utility connections for peripheral work spaces.

The principal basis upon which the Martin invention is founded is the use of a central core unit for local ventilating, where the core unit also provides utility connections to peripheral work spaces around the core. A work space fan is mounted in a side wall of the cabinet. That fan is operable under user control to draw air from the work space into the plenum defined by the walls of the cabinet. The wall is then discharged to the common area directly above the work space.

No system is perfect, however, and several drawbacks have been encountered in the use of the Martin system. Most of those drawbacks have been solved by the air circulation system described in commonly owned Mitchell et al U.S. Pat. No. 5,065,668. For the first time, it has been possible to obtain a class 100,000 rating for an office space, which result is highly desirable for health reasons as well as for insurance ratings. The system comprises the construction of a core having an inlet which draws in ambient air and an outlet which exhaust air such that the air flow combines with side walls of a work station to enclose an individual in a work station in an envelope of processed air. Most newly installed work spaces can take advantage of the Mitchell et al air circulation system to produce a plurality of work stations of optimum air quality and to improve air quality in the entire room.

The Mitchell et al system requires the construction of a central core of at least sufficient size to process the air through the inlet and outlet. New construction of work stations is improved by the Mitchell et al design giving a better alignment of work space for a given quantity of available space. However, many work station presently exist and would be suitable for continued use if the quality of the environment surrounding the work station could be improved. These existing work station typical converge upon a central point rather then on a central core. These existing work stations may be visualized as being two or more walls which intersect each other to define work station which are separated by a portion of each wall.

It is an object of this invention to provide a device which would significantly improve the environment of these work station without requiring major modification or replacement of the existing walls.

Another object of the present invention is to provide a device which is useful with existing work station arrays to provide an envelope of clean air for at least one individual work station.

Yet another object of the present invention is to provide a device which is suitable for maintaining air quality and air temperature at desirable levels while using as much of existing work station arrays as possible.

Other objects will appear hereinafter.

SUMMARY OF THE INVENTION

It has now been discovered that the above and other objects of the present invention may be accomplished in the following manner. Specifically, a device has been discovered for use in a work station array which includes at least one work space defined in part by side walls intersecting at a point.

The device of the present invention includes an air circulation unit including mounting means for mounting the unit on at least one wall of a work space defined in part by side walls intersecting at a point. The air circulation unit is mounted at a location proximate the intersecting point of the side walls.

The air circulation unit includes an air inlet means for drawing ambient air into the unit. Also included is an air discharge means on the unit for discharging air in a predetermined controlled direction to cooperatively form an envelope of air surrounding a space. This space is defined by part by the side walls proximate the unit and in part by air flow out of the discharge means and into the air inlet means, so that an individual in the work station is enclosed in air having superior quality to ambient air.

Air is circulated through the unit from the inlet to the outlet or discharge by means of an air circulation means. This air circulation means preferably has the capacity to provide up to thirty changes of air per hour for the envelope. Preferably, the air circulation means includes a blower having at least a 300 cubic feet per minute rating. This blower is preferably the sole air moving means causing air to enter and exit the unit.

In a preferred embodiment, the discharge means is formed by a top for the unit which is raised from the unit by a distance sufficient to define a small gap. The unit is placed against the intersecting side walls at the point of intersection so that as air is drawn into the unit at the bottom and discharged at the top of the unit, the side walls block passage of air in every direction except out over the individual sitting at the work space.

In one embodiment, the unit includes an internal divider which divides the unit into a lower air intake chamber and an upper air discharge chamber. The air circulation means includes a filter for filtering the air circulated between the lower air intake chamber and the upper air discharge chamber. Substantially all circulated air passes through the filter as it flows between the air intake chamber and the air discharge chamber. A filter is provided on the air transfer means to substantially improve the quality of air.

Specific filters which are preferred are those filters known as HEPA filters which have a minimum efficiency of 99.97% of the particles measured at 0.3 microns. In addition to the HEPA filter, a pre-filter may be employed which is suitable for removing odors and- /or large particulate matter from the air passing through the filter. Activate charcoal and polyester filters may be used to remove odor and/or large particles respectively. One important feature of the present invention is the ability of the air circulation means to pass sufficient air through the unit to virtually eliminate variations in the temperature of the air which contacts or encloses the individual at the work space.

In its preferred form, the air circulation unit includes a single motor and blower mounted between the lower intake chamber and the upper discharge chamber. The blower has sufficient capacity to provide up to 30 air changes per hour for the region enclosing the individual. As will be shown herein after, installation of such a unit in a presently existing work space provides an unexpected improvement in air quality control.

BRIEF DESCRIPTION OF THE DRAWINGS

These and other objects of the present invention and the various features and details of the operation and construction thereof are hereinafter more fully set forth with reference to the accompanying drawings, where.

DETAILED DESCRIPTION OF THE PREFERRED EMBODIMENT

Figure 1:
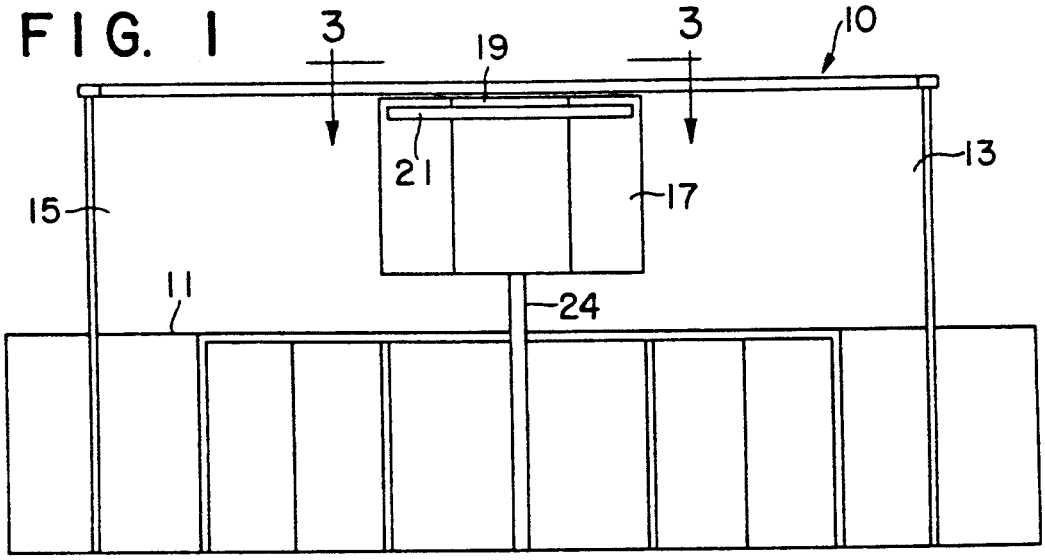
FIG. 1 is a front elevation view of a work station showing the device of this invention positioned at the intersection of 2 side walls.

A work station array is shown generally in FIG. 1 by the reference numeral 10 and includes side walls which intersect at a common point to define the work stations. Individual work stations have desk work surfaces 11 which allow for equipment and work to be placed before the worker as needed. Positioned above desk 11 and attached in part to side wall 13 and in part to side wall 15 is an air circulation system 17 for circulating air as will be described. Top wall 19 is spaced above the unit 17 to provide an air discharge space 21 for discharging air into the work space. Air is taken into unit 17 through air inlet 23, located at the bottom of the unit.

The air circulation unit 17 is shown in an installed position with lid 19 flush against walls 13 and 15, in FIG. 2, with lid 19 being placed slightly below the top of walls 13 and 15 so that air discharge space 21 faces out over the area defining the work space.

Figure 2:
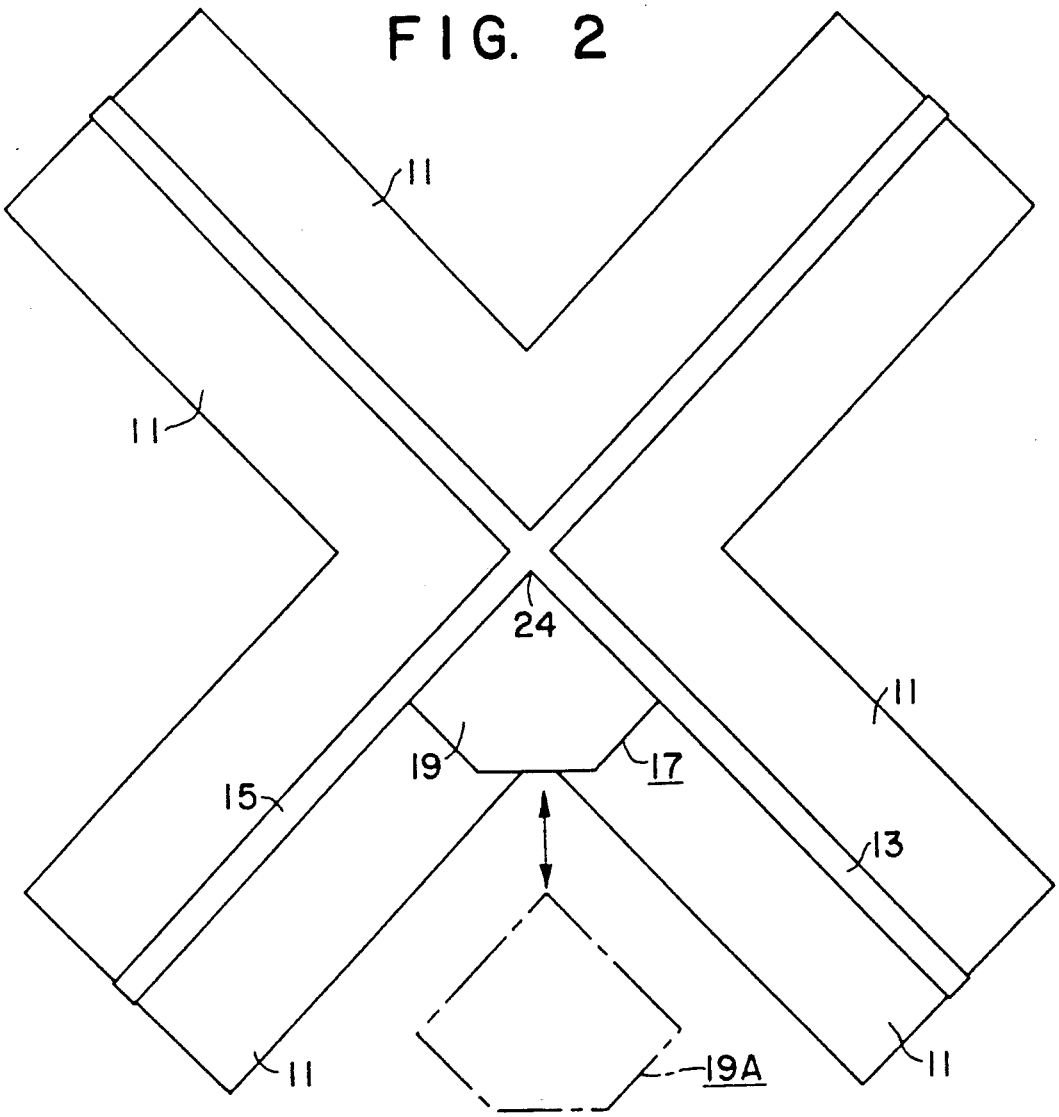
FIG. 2 is a plan view of the work station of FIG. 1 with the air circulation shown in place in full line and in dot and dash line prior to mounting.

The present invention is designed to be used with already existing work spaces so that, as shown in FIG. 2, a unit 19A may be placed in operation by mounting the unit on at least one side wall 13 or 15, or both as shown in FIG. 2 at a location proximate the intersection point 24 of walls 13 and 15. Thus centered in the work space, unit 19A is capable of providing an envelope of air from the discharge space 21 out over the person using the work space and back into air inlet 23. Since the air discharge space 21 is below the top of walls 13 and 15, all of the air discharged from the air circulation unit 17 extends out from the side walls 13 and 15. The air circulation unit is powerful enough to create a plurality of air changes per hour so as to create an envelope of superior quality air surrounding the person working in the work space.

Figure 3:
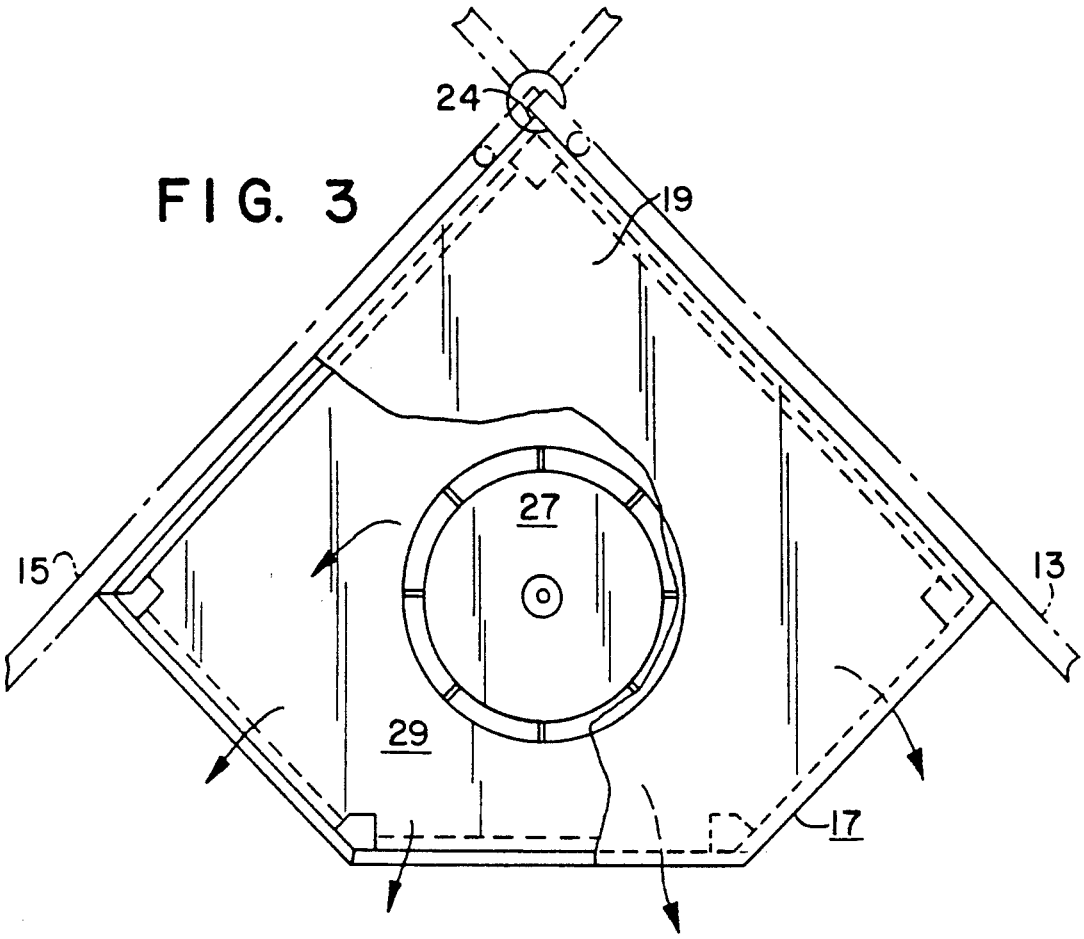
FIG. 3 is a enlarged fragmentary plan view taken along line 3,3 of FIG. 1, showing an air circulation unit in greater detail with portions broken away and sectioned.
Figure 4:
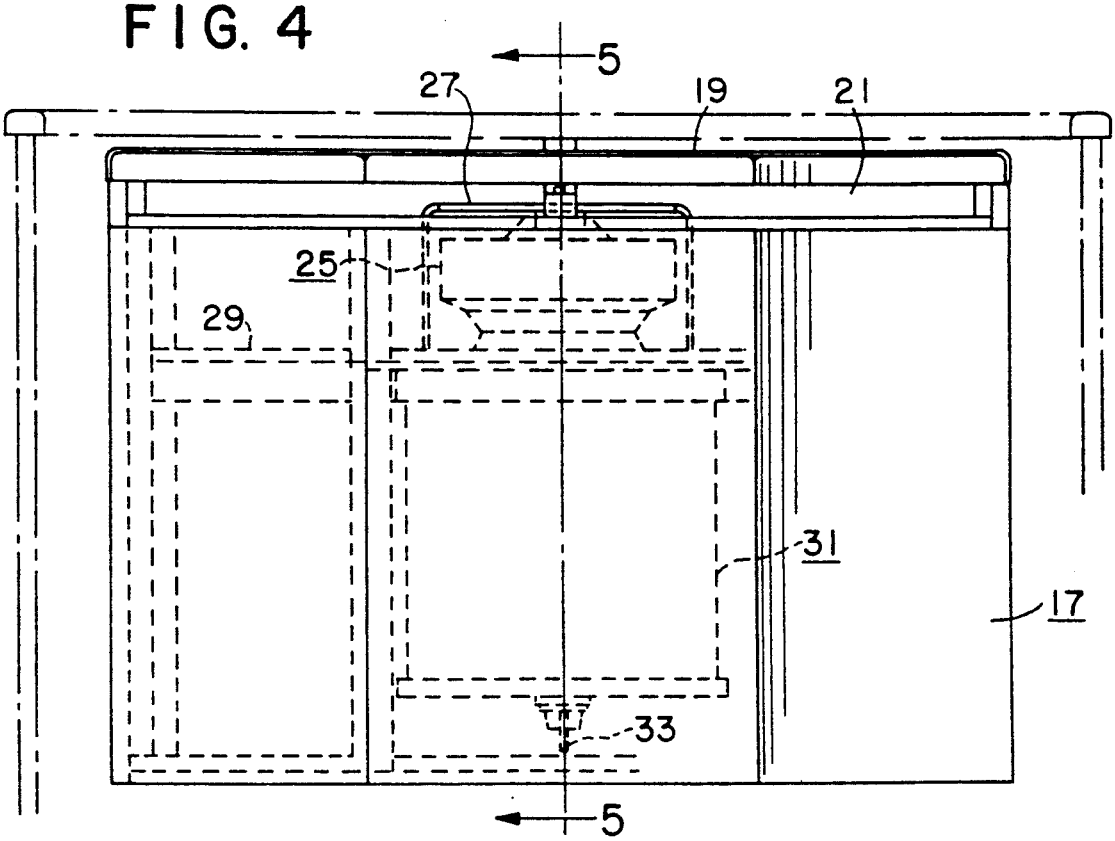
FIG. 4 is a front elevational view of the unit shown in FIG. 3.

FIG. 3 is an enlarged fragmentary plan view of the device shown in FIG. 2, showing the unit in greater detail with portions broken away and in section. The relationship between the unit lid 19 and side walls 13 and 15 can be seen. Air exits beneath the unit lid 19 as shown by the arrows indicating flow of air. Air, which is driven by motor/blower 25, shown in FIG. 4, exits the blower exhaust cap 27 into the area beneath unit lid 19, thereafter flowing out over the person using the work space. Located in the unit 17 is blower motor 25, positioned on the top half of platform divider 29. Filter 31, in this case a HEPA filter, is located below platform divider 29. Platform divider 29 divides unit 17 into a lower intake chamber and an upper air discharge chamber. Air enters through air inlet 23 and passes through HEPA filter 31 since platform 29 does not permit flow of air through it except through the filter 31.

Filter 31 is held in place by a filter attachment wing nut assembly 33. Filter 31 comprises an air filter which is known generally as a HEPA filter. HEPA filters are commercially available and have an efficiency rating of at least 99.97% at 0.3 microns, using a DOP test procedure. Inside filter 31, a pre-filter such as activated charcoal may be used to trap odor. The pre-filter may also include a polyester or other synthetic filter for removing larger particulate matter.

Blower motor 25 is the sole source of movement of air from the lower chamber to the upper chamber and out through the discharge space 21.

Figure 5:
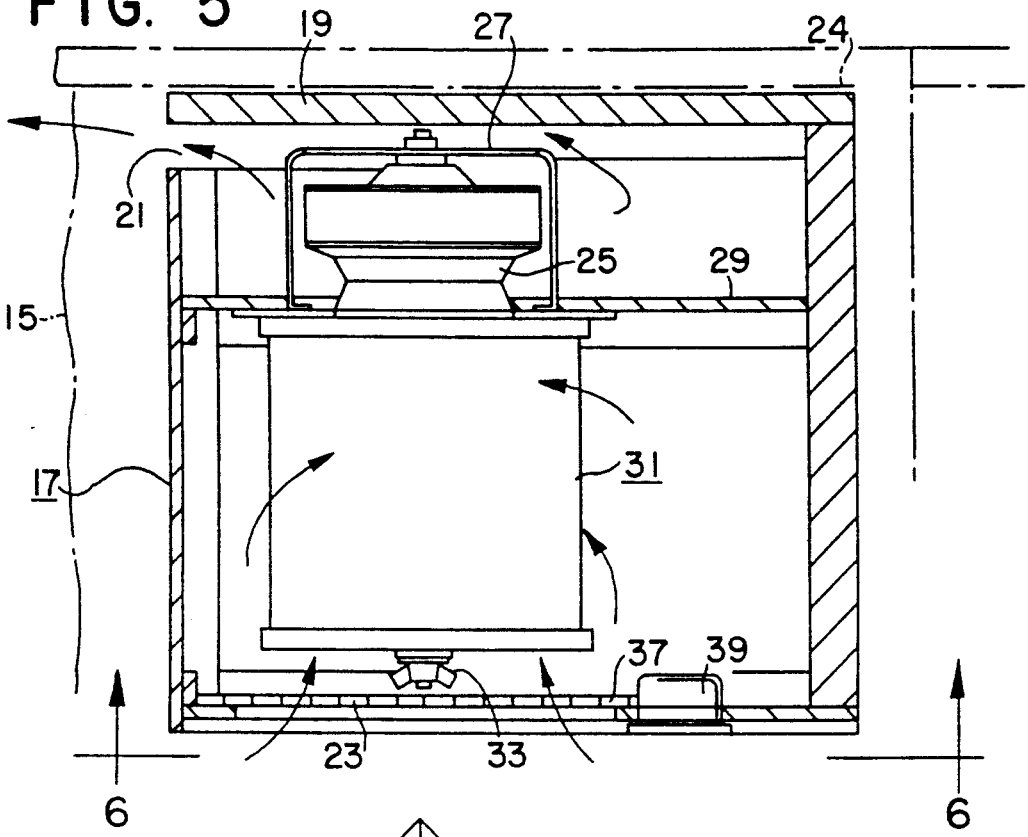
FIG. 5 is a sectional view taken along line 5,5 in FIG. 4.
Figure 6:
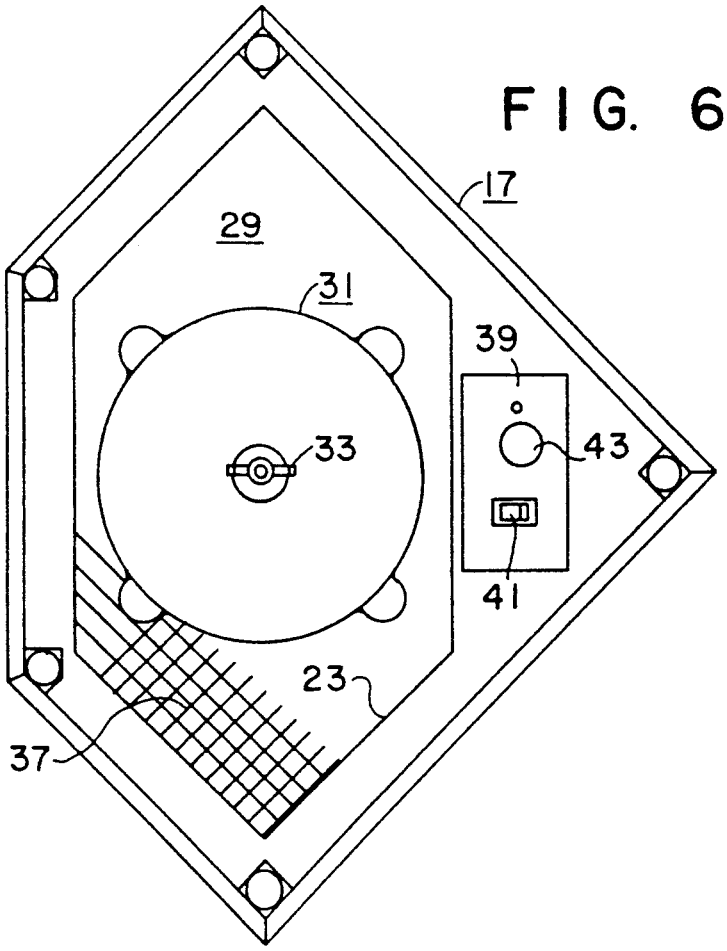
FIG. 6 is a bottom plan view taken along line 6,6 in FIG. 5.

FIG. 5 shows circulation of air as air flows into air inlet area 23 covered by a grating 37 and then through filter 31 and out via the discharge space 21. Shown operably connected to motor 25 (and other electrical devices connected with the apparatus of this invention) is a control box 39. Control box 39 includes switch 41 for activating the blower motor 25, and also contains a control knob 43 for adjusting at least the rate of transfer of air through the filter 31 and blower motor 25.

As can be appreciated, the apparatus of the present invention causes the formation of an air envelope which functions like a clean room. None of the air which circulates through the air circulation unit is directly connected to the HVAC of the building. This leads to a significant advantage in that an envelope of air is formed in which the person using the work space is protected even in an environment of less than suitable quality air in the rest of the room. In a preferred embodiment, the blower motor in capable of moving at least 300 cubic feet per minute of air. When the device is operating a full capacity, it is possible to accomplish over 30 air changes per hour within the envelope formed by the side walls and the air intake and discharge as described above.

The present invention addresses the concept of providing individual envelopes of clean air and each work station to remove problem causing particles. The invention is suitable for use with preexisting work stations defined by walls which intersect at a common point.

In order to evaluate the invention, a number of experiments were performed. It is presently known that a device similar to the present invention, as disclosed in U.S. Pat. No. 5,065,668, is capable of remarkably reducing the particle count of particles of 0.5 microns or larger in rooms where the air circulation system of that patent in employed. Specifically, it has been found the rooms which rely on an HVAC system only generate particle counts, measured as number of particles of 0.5 microns or larger per cubic foot of air, ranging from 100,000 to over 700,000 particles. Similar measurements made in rooms when the air circulation system of U.S Pat. No. 5,065,668 were employed resulted in particle count measurements which were well below 100,000 and in fact in one case was less then 28,000.

In order to demonstrate the efficacy of the present invention, which is designed to operate on one work station, particle measurements were made to determine the air quality inside and outside of the envelope of air generated by the air circulation unit of this invention. Specifically, one air circulation unit of the present invention was installed in one work station in a multiple station unit located in an office. The particle count of particle in the air in the office room averaged approximately 400,000 particles of 0.5 microns or larger per cubic foot of air. An air circulation unit of the present invention was installed and operated for a period of time generating an envelope of air extending out from the air discharge over the individual working in the specific work station and back into the air inlet. The unit was operated to maintain a steady state of air so that 10 to 30 complete changes of air in the envelope were accomplished per hour. Air quality inside the envelope, where the employee would be stationed for work, had substantially reduced particle counts, again below 100,000 particles per cubic foot of air. Thus the unit of the present invention is capable of modifying existing structures to provide the advantages of new construction at a small fraction of the cost which would otherwise be required. Even though the particle count and air quality away from the particular work station on which the present invention was attached were unacceptable, air quality within the envelope of air was surprising and superior in quality.

The present invention has also been found to be admirably suited for substantially reducing the dissatisfaction expressed by persons working in a office work place, particularly as it related to being too hot, too cold, too stuffy, or too drafty. It has been determined that when temperature, humidity radiant heat loss, air flow velocity and other climatic conditions are measured within a specified space, it is possible to determine the number of occupants who will feel discomfort. Under optimum conditions, that is, when most people are perfectly satisfied, there are approximately 5% who are still not satisfied. Thus, it is never possible to satisfy everyone and optimal environmental conditions in work places are defined by a statistical analysis to be those at which 95% of the occupants feel no discomfort, with perhaps 2.5% feeling too cold and another 2.5% feeling too warm.

An office space was selected which had a plurality of work stations of the type described herein. A thermostat for controlling temperature was provided which alternately turned a heating and cooling system on to keep the temperature within 1° C. at the thermostat location. Inside a work station, an instrument was installed to measure temperature, humidity, air velocity and radiative temperature.

Two sets of experiments were performed. In the first set, the present invention was turned off and no air envelope was produced by the air circulation unit of the present invention. The second set of experiments were performed with the present invention operating at a capacity of approximately 300 cubic feet per minute of air flow through the air circulation unit. In the first set of experiments, it was determined that the number of responses expressing dissatisfaction, factoring out the 5% which never can be satisfied, was 904. When the present invention was operated during the second set, the number of dissatisfied responses was 215, again after factoring out the 5% who are never satisfied. Thus, complaints resulting from operation of the temperature control system was reduced from 904 to 215, a 76% reduction, merely by operating the present invention.

This surprising result is believed to be accomplished by the operation of the system to form an umbrella of protection over the employee so that a suitable blend of fresh and processed air is achieved. If a filter is used, the air quality is substantially improved. However, even without a filter, the foregoing temperature satisfaction can be achieved.

While particular embodiments of the present invention have been illustrated and described herein, it is not intended to limit the invention. Changes and modifications may be made therein within the scope of the following claims.

What is claimed is:

1. In a work station array including at least one work space defined in part by at least two intersecting side walls, the apparatus comprising:

an air circulation unit mounted on at least on side wall at a location proximate its intersection with another side wall, said unit having a top and bottom end;

air inlet means on said unit for drawing ambient air into said unit solely from one end of said unit; and air discharge means on said unit for discharging air solely from the other end of said unit in a predetermined controlled horizontal direction to cooperatively form an envelope of air surrounding a space defined in part by said side walls and in part by air flow out of said discharge means and into said air inlet means to enclose an individual in said work station in air having superior quality to ambient air without directing air directly on said individual.

2. The apparatus of claim 1, wherein said unit includes air circulation means for circulating air through said unit from said inlet means to said air discharge means.

3. The apparatus of claim 2, wherein said air circulation means has the capacity to provide up to 30 air changes per hour for said envelope of air.

4. The apparatus of claim 2, wherein said air circulation means includes a blower having a at least a 300 cubic feet per minute rating.

5. The apparatus of claim 4, wherein said blower is the sole air moving means causing air to enter and exit said unit.

6. The apparatus of claim 1, which further includes means defining a top for said unit which is raised from said unit by a distance sufficient to define said air discharge means.

7. The apparatus of claim 1, which further includes divider means dividing said unit into a lower air intake chamber and an upper air discharge chamber, said unit having an air circulation means including filter means for filtering air circulating passing between said lower air intake chamber and said upper air discharge chamber.

8. The apparatus of claim 7, wherein said filter is a HEPA filter.

9. The apparatus of claim 7, wherein said filter includes a pre-filter.

10. The apparatus of claim 7, wherein said filter further includes an odor filter.

* * * * *